United States Patent [19]

Wendell

[11] 4,093,498

[45] June 6, 1978

[54] AUTOMATIC SHIRT COLLAR STAY APPLYING MACHINE

[76] Inventor: David Wendell, 8803 Kelso Dr., Baltimore, Md. 21221

[21] Appl. No.: 795,891

[22] Filed: May 11, 1977

[51] Int. Cl.[2] ..... A41H 43/00

[52] U.S. Cl. ..... 156/494; 156/559; 156/570; 156/583; 223/4; 223/27; 223/52.3

[58] Field of Search ..... 223/2, 4, 27, 50, 52.1, 223/52.3; 2/256, 260, 260.1; 214/17 R, 622; 271/131, 142, 225, 269; 156/293, 559, 494, 583, 464, 521, 515, 570, 443, 499; 38/70, 100

[56] References Cited

U.S. PATENT DOCUMENTS

| | | | |
|---|---|---|---|
| 713,247 | 11/1902 | Shepard | 223/4 |
| 1,539,203 | 5/1925 | Palmer | 38/70 |
| 2,601,037 | 6/1952 | Liebowitz | 223/50 |
| 3,191,557 | 6/1965 | Moore | 223/2 |
| 3,810,811 | 5/1974 | Bosse | 156/522 |
| 3,925,140 | 12/1975 | Brown | 156/35 P |

*Primary Examiner*—David Klein
*Assistant Examiner*—Jerome W. Massie
*Attorney, Agent, or Firm*—J. Wesley Everett

[57] ABSTRACT

The machine is for aiding in attaching stiffening elements or stays to shirt collars or to inserts which are later attached or positioned inside the outer surface of the collar. The stays are first stamped from sheets of hard thin flexible material such as a polyester plastic and coated on at least one side with a film of heat sensitive adhesive. The stays are stacked in a magazine with the side containing the adhesive facing either upwardly or downwardly depending on which of the collar elements the stay is to be attached to. Each end of the collar, or liner, is tautly drawn over a thin shelf of the same configuration as the outline of the collar. A machine element will move the lower most stay from beneath the stack and position it within a channel to be engaged by another machine element and moved into position within the collar or liner where it is to be attached. The adhesive is then heated by a heating unit to a point to cause the adhesive to soften and adhere to the collar or liner as the case may be, after which the outer collar material, together with the collar lining, is attached to the shirt.

5 Claims, 8 Drawing Figures

86
72
71
73
74
56
54
52
44
43'
43
42
58
70
64
14
60
62
66
68
30a
12
40
50
48
12'
10
18
75
76
H
78
77
80

AUTOMATIC SHIRT COLLAR STAY APPLYING MACHINE

The invention relates to a method and apparatus for attaching a pair of stiffening elements, or stays, to each side of what is generally referred to as a shirt collar.

The primary object of the invention is to provide an apparatus or machine that will apply simultaneously a stiffening element to each side of a shirt collar, or liner, with required accuracy.

A further object of the invention is to provide an apparatus or machine that may be easily operated by unskilled labor.

A further object of the invention is to provide a machine that will greatly reduce the time of applying these stiffening elements or stays to the shirt collar.

While several objects of the invention have been set forth, other objects, uses and advantages will become apparent as the nature of the invention is further disclosed in the detailed description to follow with reference to the accompanying drawings, in which.

In referring to the detailed description like and similar reference characters are used to indicate like and similar parts throughout the several views and the term apparatus is interchangeable with the term machine.

The principal of applying the stays in each end of the collar and/or the collar liner is substantially the same, and any reference to the collar or collar liners is intended to include the other.

The complete machine is referred to by the numeral 10, which comprises preferably a table-like supporting structure on which is supported a pair of horizontal collar supporting plate members 30A and 30B.

The collar stiffening means per se is in the form of thin elongated strip members 14 as shown best in FIG. 1, and which may later be referred to as a stay. These stay members are provided on at least one side thereof with a thin coating of heat sensitive adhesive, preferably in the form of a polyester film 18. The side of the stay carrying the polyester film 18 is placed adjacent the collar material or the liner 12 to which it is to be attached after which heat is applied to the area of the stay for causing the adhesive to soften and adhere to the collar or liner material. It is possible that under certain types of construction both sides of the stay may carry the heat sensitive adhesive.

Figure 2:
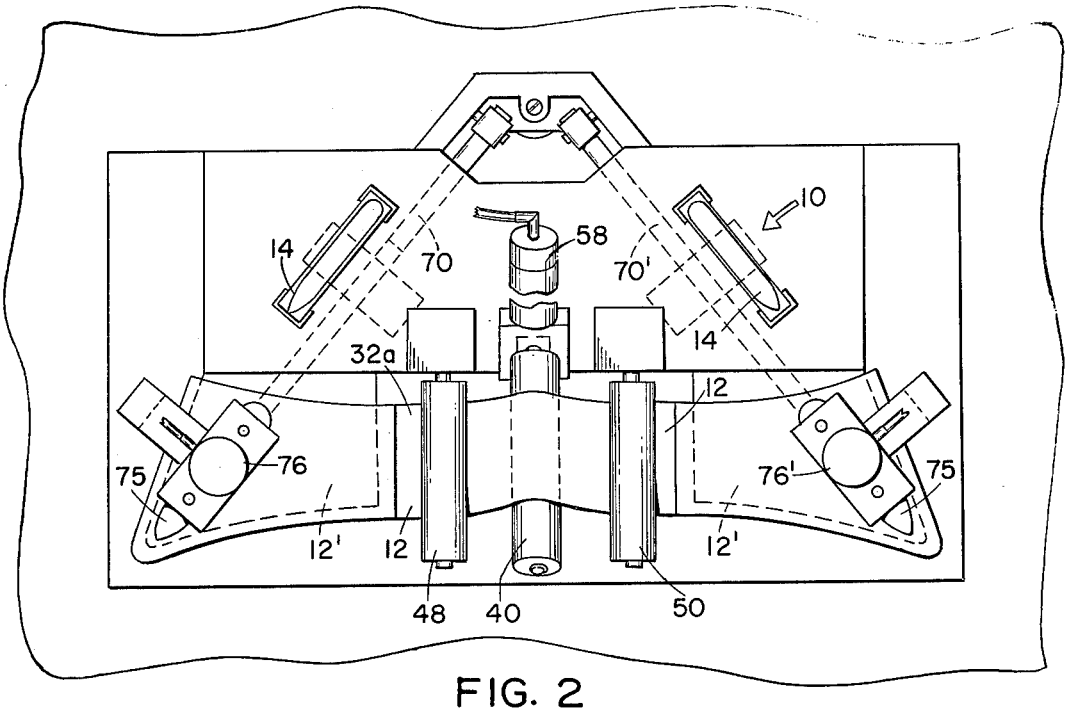
FIG. 2 is a top plan view of the apparatus.
Figure 3:
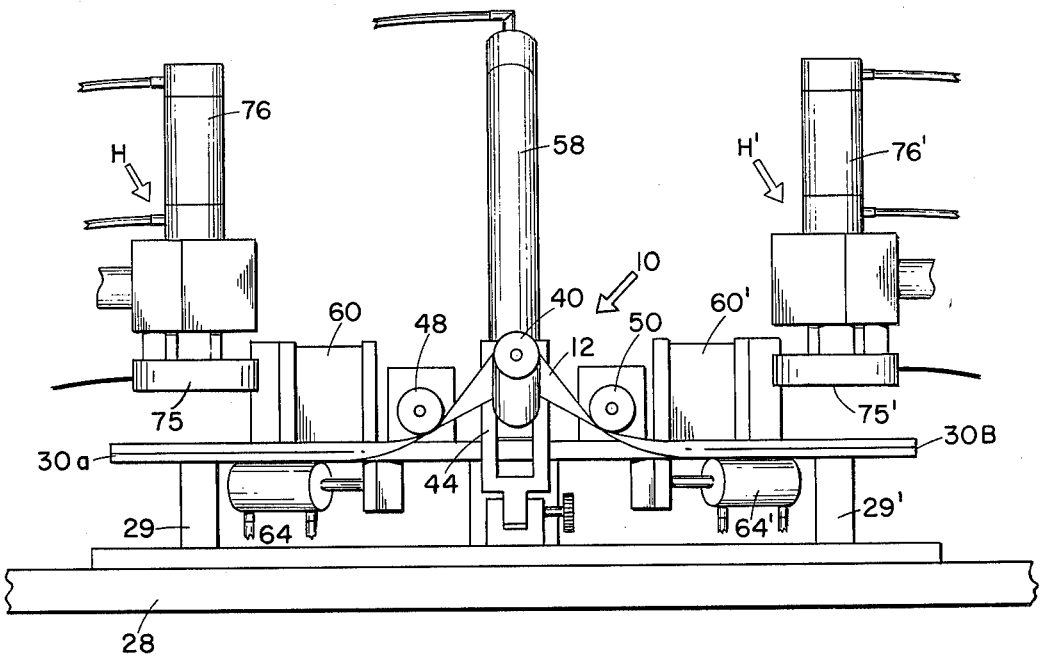
FIG. 3 is an elevational view of the same.

The collar liner 12 and 12' is used to give the finished shirt collar a stiffened effect and is generally formed from a semi-stiff material such as buckram, but is not limited thereto. The machine is designed for duplicate operation, that is, it places a stiffening stay at each end of the collar, or liner simultaneously, as shown in FIG. 2.

The plate members 30A and 30B are supported above table top 28 on spacers 29 and 29' and are of substantially thin construction which are adapted to receive the ends of the collar or collar liners. In the drawings the liners are shown in double thickness adjacent the ends of the collar which provides the end of the liner with a pocket into which the stay is inserted. These pockets are constructed before they are placed into the machine and the plates 30A and 30B are inserted into these pockets and drawn in close contact with the plates 30A and 30B by a tightening roll 40.

The tightening roll 40 is mounted for vertical adjustment centrally of the machine and is supported upon a substantially horizontal axle 42 which is, in turn, supported at one end by a member 52 slidably supported in a bifurcated member 44. The roller 40 is free floating and may be tilted from its horizontal plane by moving the linkage either forward or backward relative to the machine as indicated by the arrows 43 and 43'. The member 52 is provided with a stem 54 which in turn is connected to the upper end of a compressible spring. The block is forced downwardly by a suitable air cylinder 58 and is moved upwardly by the action of the spring 56.

On each side of the central tightening roller 40 are free-floating rollers 48 and 50. The idle rollers 48 and 50 are for keeping the collar material in a plane with the plates 30A and 30B, and the central roller moves the collar material or liner upwardly between the two idle rollers to draw the ends of the collar or liner material tautly against the outer edge of the plates 30A and 30B.

The stays 14 are fed into the machine by providing a magazine 60 in which the stays are stacked. Slideable beneath the stack is a plate 62 which is timely operated by an air cylinder 64. The plate 62 is provided with a recessed face of such depth as to receive a single stay as shown at 66 in FIG. 4. The plate 62 engages a single stay and moves it to a channel formed in the member 68. Operating within the channel member 68 is a semi-rigid band 70 which is movable along and within the channel 68 for moving the stay from the point at which it is deposited by the member 62 to the position within the pocket of the collar or liner where it is attached to the collar element, after which the band 70 is retracted by the operation of a switch 72 and a pin 71 controlling the air cylinder 74 to cause a return of the band to its starting position. The screw 73 limits the movement of the semi-rigid band 70 through the channel 68 to control the final position of the stay within the collar member.

Figures 1, 4, 5, 6, 7, 8:
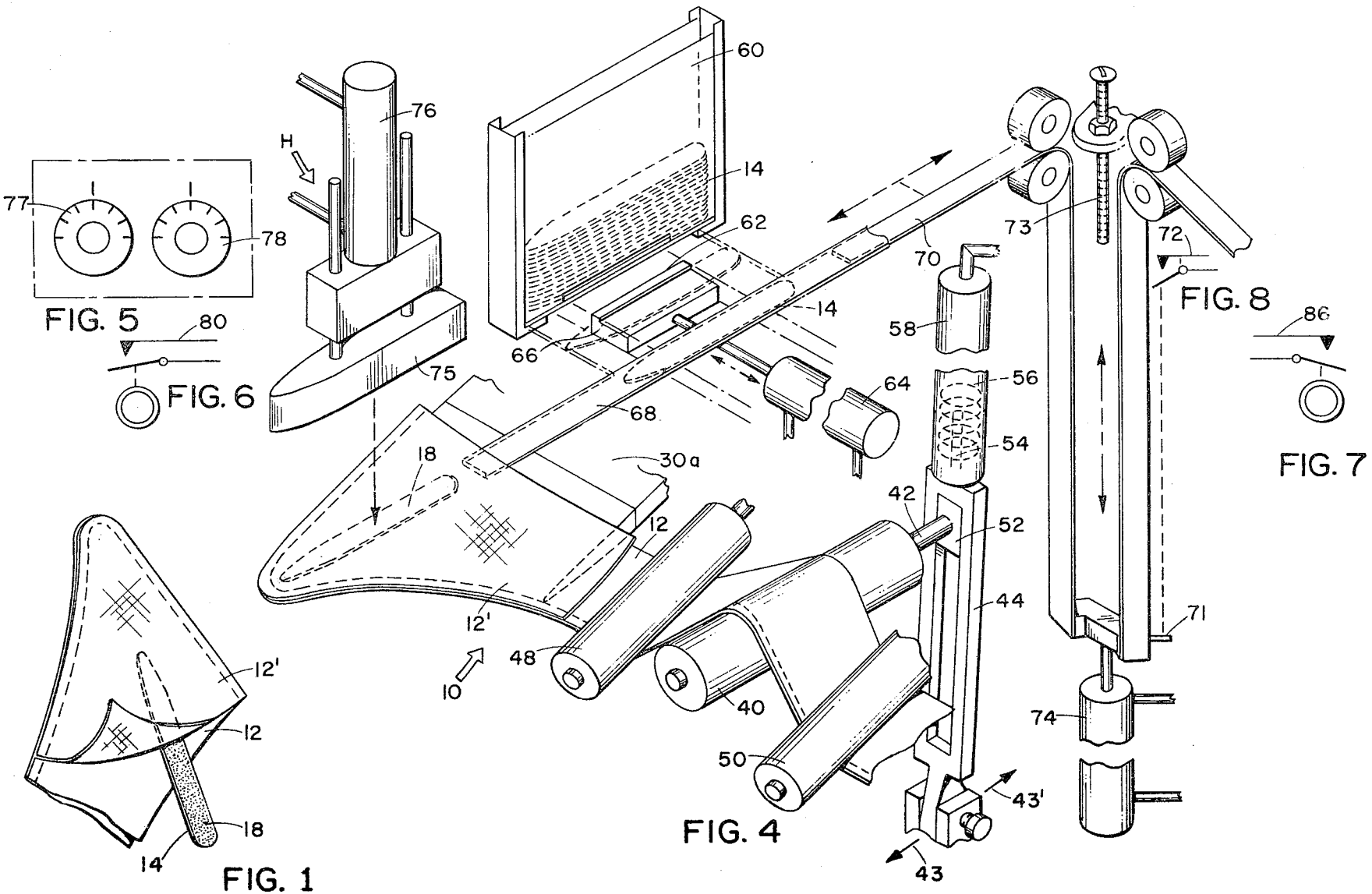
FIG. 1 is a fragmentary perspective view of a portion of a shirt collar showing a stay being inserted within a collar unit.
FIG. 4 is a perspective detail view of one side of the apparatus illustrating more in detail the operation of the machine.
FIG. 5 is a diagramatical view of a temperature and timing switch for the heating means.
FIG. 6 is a diagramatical view of an electrically operated switch for operating a means for carrying out the first phase of the operation of the machine.
FIG. 7 is a diagramatical view of an electrically operated switch for setting in motion the second phase of the operation for actually applying the stays to the collar element.
FIG. 8 is a diagramatical view of an electrically operated switch for releasing the motion of the feeding mechanism.

The stay is attached to the collar material by a heating unit carried in an assembly as shown at H in FIG. 4. The unit as shown at H is fixedly positioned over the area where the band 70 deposited the stay. The element 75 containing the heating unit is lowered to the area of the stay by a timed operated air cylinder 76, and through appropriate electrical wiring, heat is applied and the adhesive film is softened and the stay is fixed to the collar or liner as the case may be.

In FIG. 5 is shown a diagramatical view of a switch 77 for controlling the temperature of the two heating units, and at 78 is shown a timing gauge for registering the period the heating element is in operation.

Since the machine is duplicated for the same operation on the other end of the collar or liner, it is not deemed necessary to repeat the detailed description of the machine or its operation. Instead of repeating the reference numerals for the duplicated side of the machine, the same numbers are used and are identified as prime numbers.

To begin the operation, a collar or liner is placed over the ends of the plates 30A and 30B, and is normally of double thickness which allows the stays to be inserted between the two layers of material. To start the operation, the button 80 is depressed which will cause the tightening roller 40 to move upwardly drawing the ends of the collar, or liner material, tightly against the said plates 30A and 30B. The machine will not operate further until a second button 86 is depressed. This gives time for making any adjustments of the collar or liner before the stays are actually attached thereto. By depressing the button 86, the final phase of the operation of the machine will begin and carry through until the stays are fixed into the collar assembly as previously described after which the machine will automatically return to its starting position, when the collar element with the attached stiffening stay may be removed.

The operations are all electrically controlled through electric controlled air cylinders as previously referred to. Any number of control elements may be installed to effect the proper operation of the apparatus, such as, the moving of the various elements in timed relationship. For example, switch 80 operates only the tightening roll 40, and the switch 86 is for starting the operation of a complete cycle of attaching the stays to the collar element. The apparatus as stated is substantially automatic throughout except for the starting and stopping and placing of the stays within the magazines.

While the invention is shown in its preferred form, it is not intended as a limitation as the scope of the invention is best defined in the appended claims.

I claim:

1. A machine for adhesively attaching a stiffening stay to the end sections of collar materials wherein the stiffening stays are provided with a heat sensitive adhesive on at least one side thereof, comprising:

a. a frame for supporting said machine;

b. a pair of spaced collar or liner material supporting members spaced apart and in substantially the same plane and of substantially the same contour as the end of a collar or liner material, said supporting members being of such thickness as to be receivable between at least two layers of the collar or liner material;

c. a collar or liner tightening member positioned on said frame between the two collar or liner material supporting members having means for engaging the said collar or liner material and moving the same in a plane perpendicular to the plane of the collar or liner material supporting members for moving the end portions of the collar or liner material inwardly against the ends and outer edges of the said collar or liner supporting members;

d. said stays being formed of a flexible polyester plastic;

e. a pair of spaced magazines for carrying a stack of stays in each of said magazines adjacent the ends of said collar or liner materials supporting members;

f. means for automatically placing a single stay from each stack in position on the collar or liner material supporting means adjacent each end of the collar or liner material;

g. heating means positioned adjacent the location of the stays positioned on the collar or liner material, and means for moving the heating means in close proximity of the said stays and means for supplying heat to the said stays for a predetermined period to soften the said adhesive carried thereon sufficiently to adhesively bind the stays to the collar or liner material.

2. A machine for adhesively attaching a stiffening stay to the end sections of collar materials wherein the stiffening stays are provided with a heat sensitive adhesive on at least one side thereof, comprising:

a. a frame for supporting said machine;

b. a pair of spaced collar or liner material supporting members spaced apart and in substantially the same plane and of substantially the same contour as the end of a collar or liner material, said supporting members being of such thickness as to be receivable between at least two layers of the collar or liner material;

c. a collar or liner tightening member positioned on said frame between the two collar or liner material supporting members having means for engaging the said collar or liner materials for moving at least the end portions of the collar materials or liner inwardly against the outer ends of the said collar supporting members;

d. said stays being formed of a flexible polyester plastic;

e. a pair of spaced magazines for carrying a stack of stays in each of said magazines adjacent the ends of said collar or liner materials supporting members;

f. means for automatically placing a single stay from each stack in position on the collar or liner material supporting means adjacent each end of the collar or liner material;

g. heating means positioned adjacent the location of the stays positioned on the collar or liner material, and means for moving the heating means in close proximity of the said stays and means for supplying heat to the said stays for a predetermined period to soften the said adhesive carried thereon sufficiently to adhesively bind the stays to the collar or liner material.

3. The machine of claim 2 wherein the heat sensitive adhesive carried by the polyester plastic stay comprises a thin coating of polyester fusible film.

4. A machine for adhesively attaching a stiffening stay to the end sections of collar or liner materials wherein the stiffeninng stays are provided with a heat sensitive adhesive on at least one side thereof, comprising:

a. a frame for supporting said machine;

b. a pair of spaced collar or liner material supporting members spaced apart and in substantially the same plane and of substantially the same shape as the end of a collar or liner material, said supporting members being of such thickness as to be receivable between at least two layers of the collar or liner material;

c. a collar or liner tightening member positioned on said frame between the two collar or liner material supporting members having means for engaging the said collar or liner materials for moving at least the end portions of the collar or liner materials inwardly against the outer ends of the said collar supporting members;

d. said stays being formed of a flexible polyester plastic;

e. means for positioning a single stay adjacent each end of the collar or liner material;

f. heating means positioned adjacent the location of the stays positioned on the collar or liner material, and means for moving the heating means in close proximity of the said stays and means for supplying heat to the said stays for a predetermined period to soften the said adhesive carried thereon sufficiently to adhesively bind the stays to the collar or liner material.

5. The machine of claim 3 wherein the heating sensitive adhesive carried by the polyester plastic stay comprises a thin coating of polyester fusible film.

* * * * *